US011377334B2

(12) United States Patent
Fischer et al.

(10) Patent No.: US 11,377,334 B2
(45) Date of Patent: Jul. 5, 2022

(54) INDUSTRIAL TRUCK WITH AT LEAST ONE HYDRAULIC MAST LIFT CYLINDER

(71) Applicant: Jungheinrich Aktiengesellschaft, Hamburg (DE)

(72) Inventors: Kai Fischer, Hamburg (DE); Johannes Michael Frey, Louisenhof (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 296 days.

(21) Appl. No.: 16/288,522

(22) Filed: Feb. 28, 2019

(65) Prior Publication Data

US 2019/0263648 A1 Aug. 29, 2019

(30) Foreign Application Priority Data

Feb. 28, 2018 (DE) ..... 10 2018 104 586.7

(51) Int. Cl.
*B66F 9/08* (2006.01)
*B66F 9/22* (2006.01)

(52) U.S. Cl.
CPC . *B66F 9/08* (2013.01); *B66F 9/22* (2013.01)

(58) Field of Classification Search
CPC ..... B66F 9/08; B66F 9/22
See application file for complete search history.

(56) References Cited

U.S. PATENT DOCUMENTS 3,247,768 A 4/1966 Tennis
3,285,282 A * 11/1966 Martin ..... G05D 7/0133 137/504
3,357,451 A 12/1967 Tennis
3,486,333 A 12/1969 Thomas
3,685,537 A * 8/1972 Kita ..... F16K 17/26 137/493.6
4,065,922 A 1/1978 Ott et al.
4,089,168 A * 5/1978 Budzich ..... F15B 11/0445 137/596.12
4,598,797 A 7/1986 Schultz
4,716,929 A * 1/1988 Tomer ..... G05D 16/10 137/505.13
5,666,295 A * 9/1997 Bruns ..... B66F 17/003 177/139

(Continued)

FOREIGN PATENT DOCUMENTS

DE 1913575 A 3/1969
DE 10202607 C1 7/2003

(Continued)

OTHER PUBLICATIONS

EP 19158782.3; filed Feb. 22, 2019; EP Search Report dated Aug. 1, 2019 (7 pages).

*Primary Examiner* — Michael A Riegelman
(74) *Attorney, Agent, or Firm* — Barclay Damon LLP

(57) ABSTRACT

An industrial truck having at least one hydraulic mast lift cylinder, which is connected to a hydraulic block via a hydraulic arrangement that limits a lowering speed of the mast lift cylinder. The hydraulic arrangement is formed to limit the lowering speed in a load-dependent manner to at least two maximum values. A first maximum value is given for the lowering speed at the nominal load while a second maximum value is given for the lowering speed with a load that is smaller than the nominal load, i.e., wherein the first maximum value is less than the second maximum value.

7 Claims, 5 Drawing Sheets

(56) References Cited

U.S. PATENT DOCUMENTS 6,135,694 A * 10/2000 Trego ..... B66F 9/24 414/21
6,779,340 B2 * 8/2004 Pfaff ..... E02F 9/2025 60/422
7,434,393 B2 * 10/2008 Hesse ..... E02F 9/2296 60/422
8,726,646 B2 * 5/2014 Riedel ..... F15B 21/087 60/422
10,183,852 B2 * 1/2019 Das ..... E02F 9/2228
2003/0136124 A1 * 7/2003 Albert ..... B66F 9/22 60/477
2004/0079076 A1 4/2004 Lazaro
2005/0011190 A1 * 1/2005 Bitter ..... E02F 9/2207 60/468
2011/0289911 A1 * 12/2011 Vonderwell ..... F15B 7/006 60/431
2013/0013159 A1 * 1/2013 Moriki ..... H02P 21/05 701/50
2013/0277584 A1 * 10/2013 McKernan ..... B66F 9/22 251/129.01
2014/0123634 A1 * 5/2014 Heybroek ..... F15B 11/00 60/327
2014/0241840 A1 * 8/2014 Tsuruta ..... B66F 9/22 414/639
2014/0260222 A1 9/2014 Yahner
2014/0331659 A1 * 11/2014 Kato ..... F16H 61/475 60/327
2014/0366951 A1 * 12/2014 Vigholm ..... E02F 9/2217 137/14
2016/0244309 A1 * 8/2016 Meloch ..... B66F 9/07
2016/0290367 A1 * 10/2016 Lillemets ..... E02F 3/422
2017/0292243 A1 * 10/2017 Okada ..... E02F 3/32
2019/0113381 A1 * 4/2019 Pangrazio ..... B66F 9/07
2019/0263648 A1 * 8/2019 Fischer ..... B66F 9/22
2019/0264715 A1 * 8/2019 Fischer ..... F15B 20/005
2020/0283279 A1 * 9/2020 Chow ..... B66F 17/003

FOREIGN PATENT DOCUMENTS

EP 0592235 A2 10/1993
EP 2058270 A1 5/2009
EP 3037678 A1 6/2016

* cited by examiner

INDUSTRIAL TRUCK WITH AT LEAST ONE HYDRAULIC MAST LIFT CYLINDER

CROSS REFERENCE TO RELATED DISCLOSURE

This application is based upon and claims priority to, under relevant sections of 35 U.S.C. § 119, German Patent Application No. 10 2018 104 586.7, filed Feb. 28, 2018, the entire contents of which are hereby incorporated by reference.

BACKGROUND

The present disclosure relates to an industrial truck having at least one hydraulic mast lift cylinder which is connected to a hydraulic block via a hydraulic arrangement. The hydraulic arrangement limits a lowering speed of the mast lift cylinder.

Lift frames on an industrial truck usually have at least one mast lift cylinder and one free lift cylinder. Mast sections in the lift frame are displaced telescopically relative to one another via the mast lift cylinder. The free lift cylinder moves a load-carrying means relative to an inner mast section. The maximum lowering speed of a lift frame is limited for the purpose of risk reduction and as specified by standards. The limit is achieved via the hydraulic arrangement by an appropriate choke. A lowering speed of 0.6 m/s, for instance, is provided for a loading state close to the nominal load. For example, a vehicle operator uses a control lever to specify a desired lowering speed, which is checked for admissibility. For reasons of safety, the hydraulic arrangement is additionally equipped with a line rupture safety valve which performs the task of preventing the load from falling in the event of a ruptured line.

In known industrial trucks, lowering the load carrier from high lifting heights after depositing the load takes a significant amount of the time. Since the industrial truck may be displaced only after the load carrier has been lowered, a waiting time arises that can add up when working with high lifting heights.

BRIEF SUMMARY OF THE DISCLOSURE

The industrial truck according to the disclosure has at least one hydraulic mast lift cylinder, which is connected to a hydraulic block via a hydraulic arrangement. This hydraulic arrangement limits the lowering speed of the mast lift cylinder. According to the disclosure, the hydraulic arrangement is configured to limit the lowering speed in a load-dependent manner to one of at least two maximum values. A first maximum value is given for the lowering speed at a particular load value, in particular at the nominal load. The second maximum value is given for the lowering speed in connection with a second load, which is smaller than the first load. The first maximum value here is smaller than the second maximum value. The solution according to the disclosure provides the possibility of lowering the mast lift cylinder in a load-dependent manner with at least two different lowering speeds. Thus, a greater load on the mast lift cylinder is lowered at a lower lowering speed. When there is a smaller load or simply its own weight, the mast lift cylinder can be lowered at a greater speed. With the embodiment of the hydraulic arrangement according to the disclosure, it is therefore possible to lower the lift mast at a fast speed again after depositing a load at a height. With continuous operation of an industrial truck, in particular at high lifting heights, this results in fast lowering when empty and significantly improved performance of the industrial truck.

In one embodiment, the hydraulic arrangement is equipped with at least two lowering paths, which are separate from each other. Each of the lowering paths has a load-break safeguard. By using two lowering paths, it is possible to switch between two lowering speeds. The use of two lowering paths does not necessarily mean that the operator can switch only between two lowering speeds in a discrete manner. It is entirely possible to provide a continuous transition between the two separate lowering paths. Each of the lowering paths is equipped with a load-break safeguard so that it is ensured that a load-break safeguard is provided for each of the lowering speeds.

In another embodiment, each of the two lowering paths defines a maximum volume flow for the lowering movement. The volume flow in this instance substantially determines the lowering speed of the mast lift cylinder.

In yet another embodiment, switching between the first and the second maximum value occurs with the aid of a pressure balance. A pressure from the mast lift cylinder is applied to the pressure balance as a control pressure. This applied pressure can be reduced or increased so that the pressure balance responds.

To switch between the two maximum values of the lowering speeds, either a check valve or a changeover valve can be provided. In the former case, the pressure balance actuates a check valve, with which one of the lowering paths (Q1) is blocked or the other lowering path (Q2) is connected, so that the first maximum value is the lowering speed for the mast lift cylinder when the lowering path is blocked and the second maximum value is the lowering speed of the mast lift cylinder when the lowering path is connected. With the check valve, a second lowering path is selectively blocked or connected in parallel with the first lowering path. With a parallel connection, the volume flows of the two lowering paths are added together such that the volume flow is added and the lowering speed is increased.

In the described embodiment, the check valve has a valve spool that is pre-tensioned against a spring force in a valve block and that, in response to a pressure in the first lowering path, is displaced against a spring pre-load in a position that closes the second lowering path. Due to the spring force, the valve spool is pre-tensioned into a position wherein the two lowering paths are connected in parallel. If the valve spool is in its spring-loaded position, then the two lowering paths are connected. If the pressure in the first lowering path rises, then this may be interpreted as a sign of a heavy load, and the valve spool is displaced into its blocking position.

In another embodiment, a changeover valve is provided, wherein it may be possible to switch between the first lowering path and the second lowering path such that either the first maximum value occurs in the first lowering path or the second maximum value occurs in the second lowering path. The changeover valve also functions with a pressure balance. The changeover valve has a valve spool that is pre-tensioned against a spring force in a valve block and that selectively blocks one of the lowering paths depending upon its position. Here, the valve spool is structurally formed such that the two lowering paths can be blocked only alternatively to each other.

In the described embodiment, a switching load value is preferably provided that is less than or equal to the nominal load, and the lowering speed is switched to the first maximum value when the switching load value is exceeded. A performance such as this is standard-compliant, since it relates to the maximum lowering speed at the nominal load.

In one configuration, a free lift cylinder of the industrial truck is provided with a further hydraulic arrangement, which can limit the lowering speed to at least two maximum values depending upon the load. As with the mast lift cylinder, a lower lowering speed can be defined for a greater load than for a smaller load in the free lift cylinder, as well, which also permits a greater lowering speed in the free lift.

BRIEF DESCRIPTION OF THE DRAWINGS

The present disclosure is explained in greater detail on the basis of two exemplary embodiments. The following is shown.

DETAILED DESCRIPTION OF THE DISCLOSURE

Figure 1:
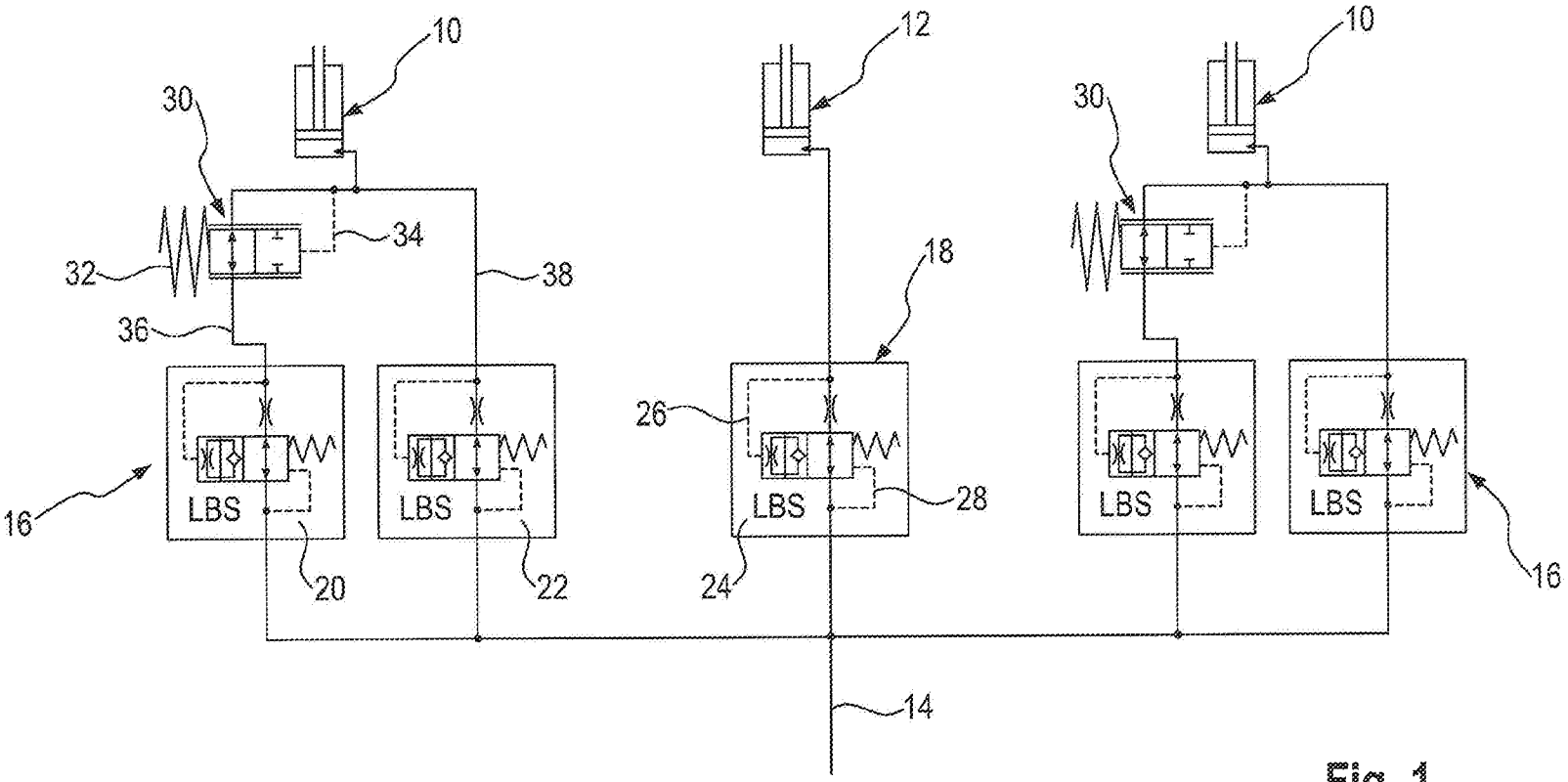
FIG. 1 depicts a hydraulic circuit plan with a check valve between a first and a second lowering path.

FIG. 1 shows two mast lift cylinders 10 and a free lift cylinder 12 in a schematic view. The differentiation between the mast lift cylinder and the free lift cylinder arises from the arrangement and function of the hydraulic cylinders in a lift frame. The lift frame comprises a plurality of telescoping mast sections, wherein the mast sections are displaced relative to one another through the mast lift cylinders. The free lift cylinder lifts the load-carrying means relative to the mast section that can be lifted the farthest.

The mast lift cylinder 12 and free lift cylinder 10 are jointly provided with hydraulic fluid via a hydraulic block (not shown). The cylinders are connected to a hydraulic block, the outlet line 14 of which has the inlet line to the hydraulic arrangements 16 and 18. The hydraulic arrangements 16 have two lowering paths 20, 22, whereas the free lift cylinder 12 in the exemplary embodiment has only one single lowering path 24. Each of the lowering paths 20, 22, 24 has a load-break safeguard (LBS), which ensures a slow controlled lowering in the event of a fault, even if there is a load. The load-break safeguard is schematically shown as a valve that is connected via a pressure balance. Here, the cylinder-side pressure 26 is compared with a pressure 28 that is choked upstream. If the difference in pressure is not too severe, then lowering is permitted downstream. On the other hand, if the difference in pressure is significant, i.e., too great as a result of a line break for instance, then a further choke 30 is activated, by means of which the lowering process is continued with a substantial restriction.

In the embodiment shown in FIG. 1, a check valve 30 is provided for the two mast lift cylinders 10. The check valve 30 is pre-tensioned by a spring 32 into the position shown for a pressure in the mast lift cylinder that is not too great. In this position, the check valve 30 is open and the mast lift cylinder 10 is lowered via the two lowering paths 36, 38. The lowering paths 36 and 38 are connected in parallel, such that their volume flows may be added together and the lowering speed may be increased.

If the load applied to the hydraulic cylinder 10 is too great, then the pressure on the control line 34 increases, and the check valve 30 switches into its blocking position. The first lowering path 36 is thereby blocked, and a lowering of the mast lift cylinder 10 takes place only via the second lowering path 38.

In practice, the check valve 30 is dimensioned such that, when the nominal load approaches, it closes, and the load and/or the section of the lift frame is lowered at an admissible lowering speed via second lowering path 38.

Figure 2:
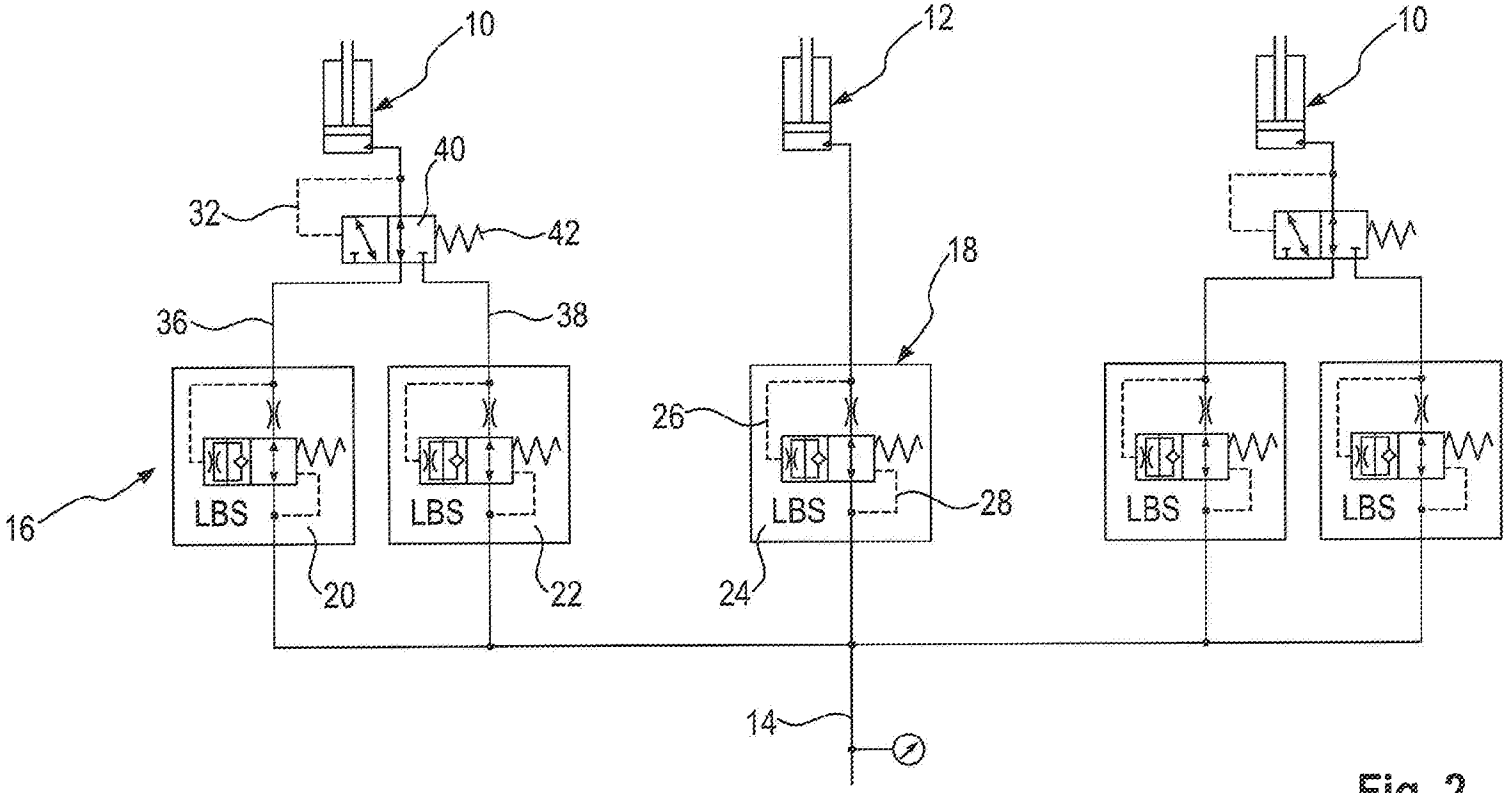
FIG. 2 illustrates a second exemplary embodiment with a changeover valve between the first and the second lowering path.

FIG. 2 shows an alternative configuration of the disclosure in a schematic view. Identical components are provided with the same reference numerals. In this configuration, first and second lowering paths 36, 38 are provided for each of the two mast lift cylinders 10. Unlike the first exemplary embodiment, a changeover valve 40 is provided, with which it may now be possible to selectively switch between the first lowering path 36 and second lowering path 38. In the position shown in FIG. 2, the lowering process occurs via lowering path 36. The check valve 40 is located in the position in which it is pre-tensioned by the spring 42. If the pressure rises in the mast lift cylinder 10, then the check valve 40 is switched via the control side 44, and the lowering process occurs solely via lowering path 38. In one embodiment according to the disclosure, lowering path 38 is dimensioned such that a maximum admissible lowering speed is not exceeded at the nominal load. On the other hand, if the load is lower than the nominal load, then a switch is made to the other lowering path 36, which, for example, has a significantly greater volume flow and thus allows for a greater lowering speed. Each of the two lowering paths 36 and 38 has its own appropriately configured load-break safeguard.

Figure 3:
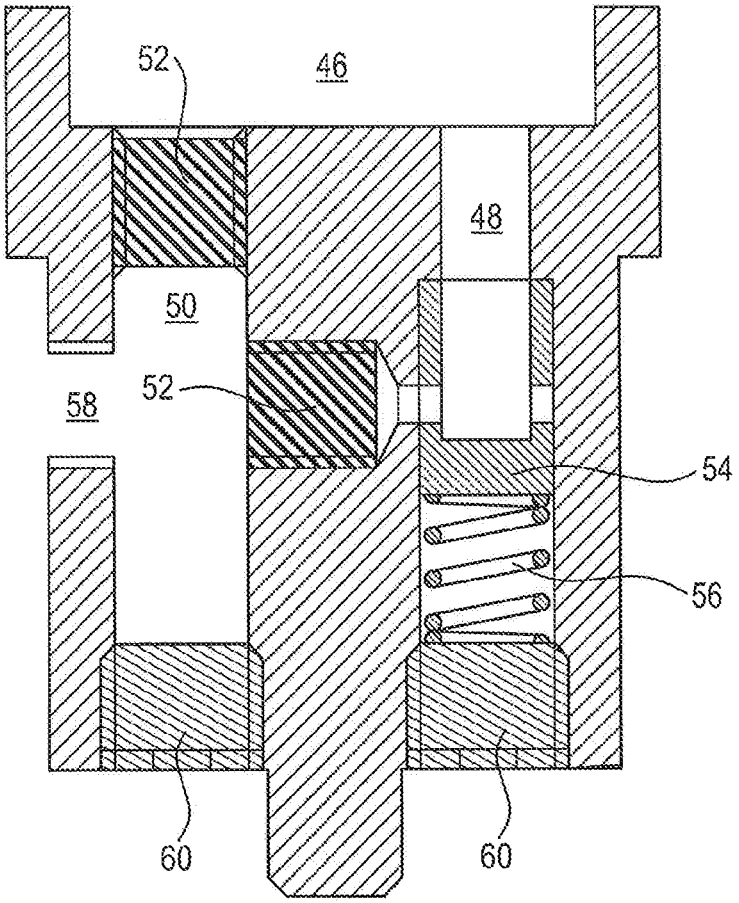
FIG. 3 shows a schematic view of a hydraulic arrangement with a check valve.

FIG. 3 shows a schematic view of a hydraulic arrangement according to FIG. 1 with a practical implementation of the check valve. FIG. 3 shows an interior space 46 of a mast lift cylinder that is linked to two lowering paths 48, 50. Each of the two lowering paths 48, 50 has a schematically represented load-break safeguard 52. A valve spool 54, which is pre-tensioned by a spring 56 into a position that releases the lowering path, is arranged in the lowering path or channel 48. If the pressure in the lowering path 48 increases, then the valve spool 54 is displaced against the tension of the spring 56 and thereby blocks the lowering path 48. In this case, only lowering path 50 is in operation in order to divert the hydraulic fluid via a connected line 58. Each of lowering paths 48 and 50 is closed by screw plugs 60.

Figure 4:
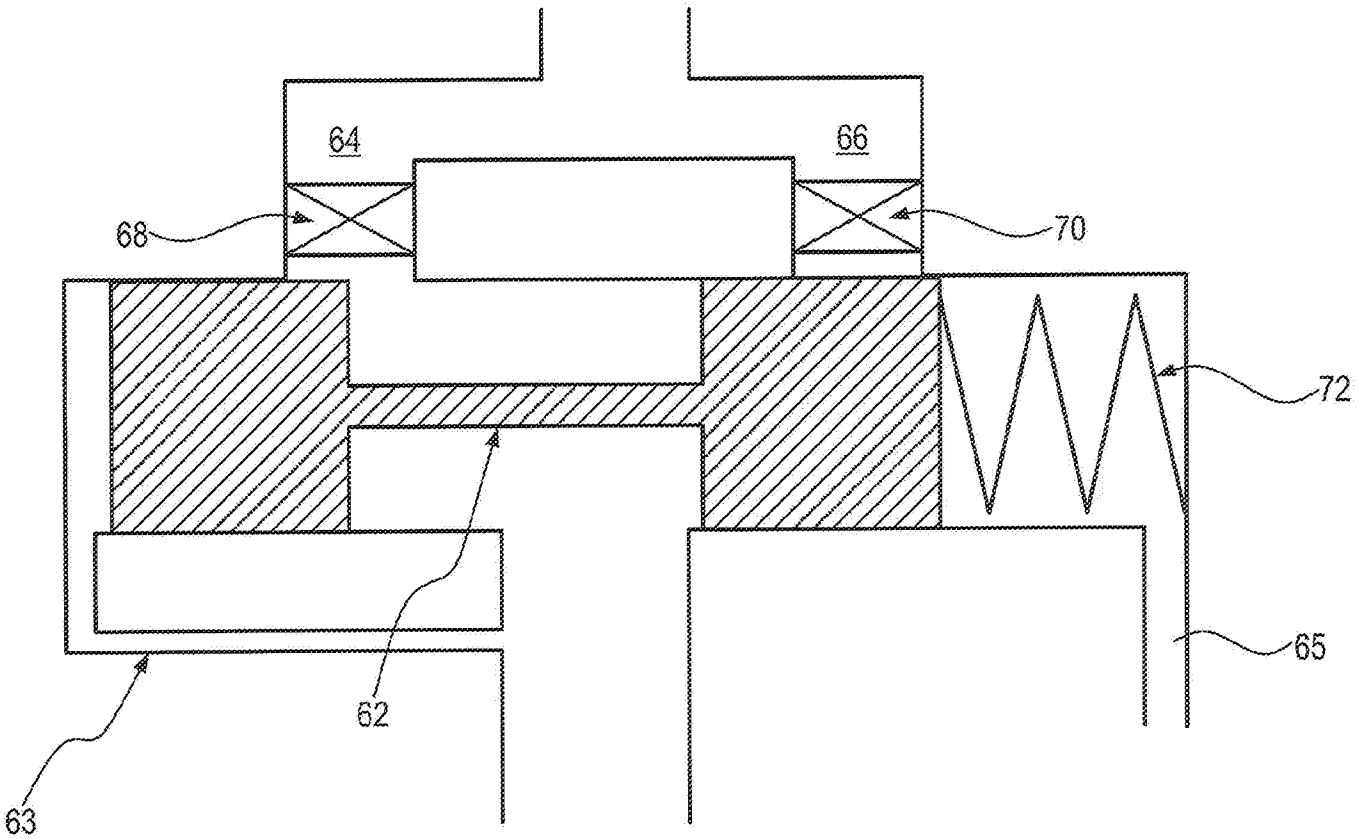
FIG. 4 depicts a schematic view of a hydraulic arrangement with a changeover valve.

FIG. 4 shows a schematic view of a changeover valve, in which a switch is made between a first path 64 and a second path 66 by means of a valve spool 62. Each of paths 64 and 66 has a load-break safeguard 68, 70. The valve spool 62 is pre-tensioned by the spring 72 into a position that blocks path 66. If the pressure in a line 63 rises, then the valve spool 62 is pushed counter to the spring force 72 into the position in which path 66 is released and which blocks path 65, which is connected to the ambient pressure and/or from the lowering path. The valve spool 62 adjusts itself depending upon the difference in pressure between the lowering path and the hydraulic cylinder. A pressure difference required for switching is determined by the spring 72.

Figure 5:
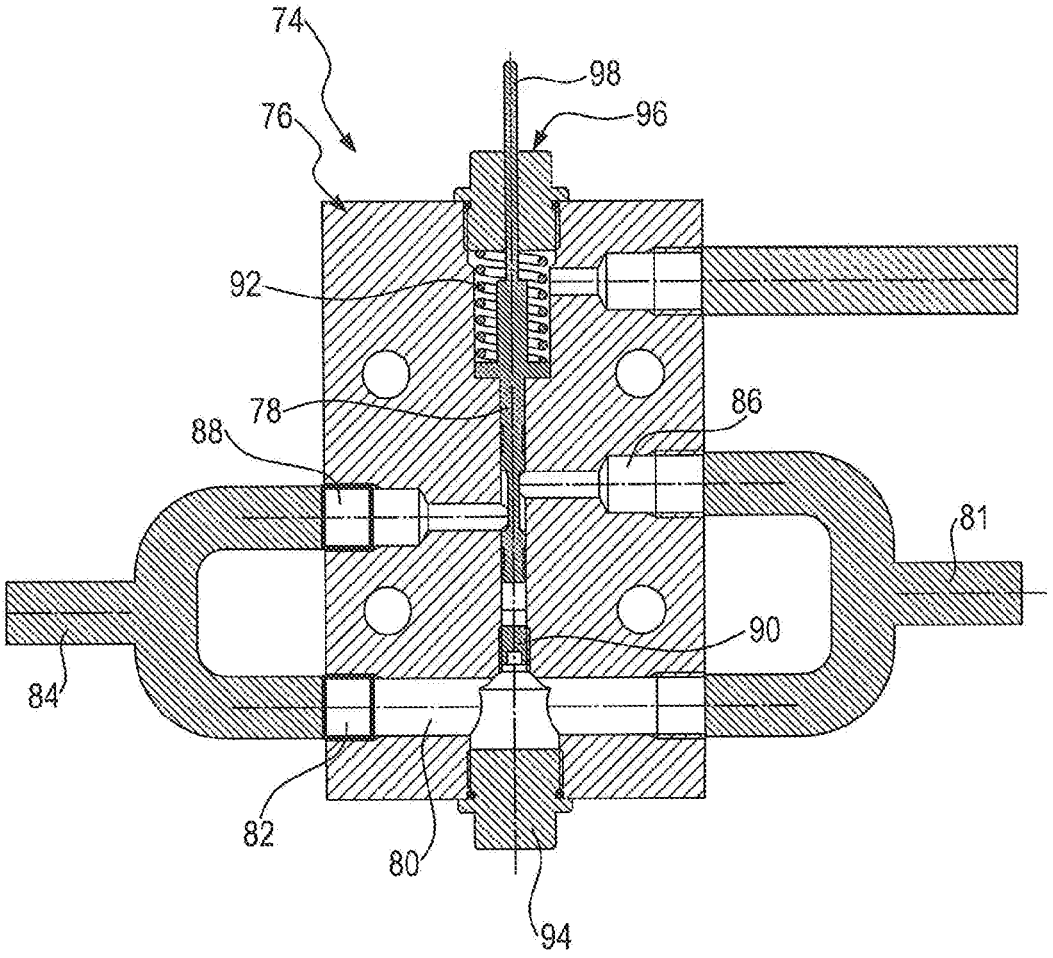
FIG. 5 illustrates a schematic view of a hydraulic arrangement with another check valve, which is different from the valve in FIG. 3.

FIG. 5 shows an embodiment of a check valve 74 in a schematic view. The check valve 74 has a valve block 76, in which a valve spool 78 is centrally arranged. In a line 81 coming from the mast lift cylinder, the hydraulic fluid exists via an outlet channel 80 and a load-break safeguard 82 through a line 84 to the hydraulic block. In the position of the valve spool 78 shown here, a second lowering path 86 is opened, such that the hydraulic fluid in the second lowering path 86 can exit via the load-break safeguard 88. The valve spool 78 is pre-tensioned by the spring 92 into its position that opens lowering path 86. The pressure from the outlet channel 80 is applied to the foot of the valve spool 78 via a choke 90. If this pressure exceeds a minimum threshold value, then the valve spool 78 is urged against or counter to the force of the spring 92 into a position blocking the lowering path 86. The valve block 76 is closed by screw plugs 94 and 96, wherein screw plug 96 has a through-hole for a projection 98 of a valve spool 78. The position of the valve spool 76 can be then be checked from outside by the projection 98 of the valve spool 78. Its intact function can thereby be tested.

REFERENCE LIST

10 Mast lift cylinder
12 Free lift cylinder
14 Outlet line
16, 18 Hydraulic arrangements
20, 22, 24 Lowering paths
26 Cylinder-side pressure
28 Choked pressure
30 Check valve
32 Spring/lowering path
34 Control line
36, 38 Lowering paths
40 Changeover valve/check valve
42 Spring
44 Control side
46 Interior space
48, 50 Lowering paths
52 Load-break safeguard
54 Valve spool
56 Spring
58 Line
60 Screw plugs
62 Valve spool
64 First path
66 Second path
68, 70 Load-break barrier
72 Spring
74 Check valve
76 Valve block
78 Valve spool
80 Outlet channel
81 Line
82 Load-break safeguard
84 Line
86 Second path
88 Load-break safeguard
90 Choke
92 Spring
94, 96 Screw plug
98 Projection

The invention claimed is:

1. An industrial truck, comprising at least one mast lift cylinder configured to lift a load carried on a load mast of the industrial truck; and a hydraulic arrangement defining multiple flow paths for delivering hydraulic fluid to the at least one mast lift cylinder, wherein the hydraulic arrangement is configured to control the at least one mast lift cylinder as a function of the load imposed in the load mast by, measuring the load imposed on the load mast, and changing the flow paths of the hydraulic fluid such that one of a first action and a second action occur in the flow paths, wherein the first action corresponds to a first load value when the first lowering speed is limited to one of the flow paths, and wherein the second action corresponds to a second load value when the second lowering speed is limited to other flow paths.

2. The industrial truck according to claim 1, wherein a load value corresponds to a nominal load value.

3. The industrial truck according to claim 1, wherein lowering speeds increase as the load value decreases.

4. An industrial truck, comprising:

a lift cylinder for suppling hydraulic fluid under pressure for lowering a load carried on a load mast;

a hydraulic system defining multiple flow paths for delivering the hydraulic fluid to the lift cylinder to effect a lowering speed of the load mast, the hydraulic system configured to measure the load imposed on the load mast; and a valve operative to supply pressure to at least one of the flow paths, wherein the hydraulic system is configured to control the valve to: (i) supply pressure to one of the multiple flow paths to effect a first lowering speed and (ii) supply pressure to another of the multiple flow paths, in parallel, to effect a second lowering speed higher than the first lowering speed, wherein the hydraulic system further comprises a pressure balance configured to actuate a changeover valve, the changeover valve configured to change the flow paths such that one of two actions occur in the flow paths, wherein a first action corresponds to a first load value when the first lowering speed is limited to one of the flow paths, and wherein a second action corresponds to a second load value when the second lowering speed is limited by to other flow paths.

5. The industrial truck according to claim 4, wherein the-changeover valve includes a valve block having a valve spool which is pre-tensioned against a spring force, and which selectively blocks one of the flow paths.

6. The industrial truck according to claim 5, wherein the hydraulic system is configured to be responsive to a switching load value which is less than or equal to the first load value, and the lowering speed switches to the second load value when the switching load value is exceeded.

7. The industrial truck according to claim 6, wherein the hydraulic system is configured to limit the lowering speed to at least two load values depending upon the load imposed on the lift cylinder.

* * * * *